US006467639B2

(12) United States Patent
Mooney

(10) Patent No.: US 6,467,639 B2
(45) **Date of Patent: *Oct. 22, 2002**

(54) HOT-FILLABLE GRIP CONTAINER HAVING A REINFORCED, DRAINABLE LABEL PANEL

(75) Inventor: Michael R. Mooney, Wrightsville, PA (US)

(73) Assignee: Graham Packaging Company, L.P., York, PA (US)

( * ) Notice: Subject to any disclaimer, the term of this patent is extended or adjusted under 35 U.S.C. 154(b) by 167 days.

This patent is subject to a terminal disclaimer.

(21) Appl. No.: 09/726,204

(22) Filed: Nov. 29, 2000

(65) Prior Publication Data

US 2001/0030167 A1 Oct. 18, 2001

Related U.S. Application Data

(63) Continuation-in-part of application No. 09/446,698, filed on Dec. 17, 1999.
(60) Provisional application No. 60/148,872, filed on Aug. 13, 1999.

(51) Int. Cl.[7] ..... B65D 6/38
(52) U.S. Cl. ..... 215/384; 215/381; 220/673
(58) Field of Search ..... 215/379, 382–384; 220/669, 673

(56) References Cited

U.S. PATENT DOCUMENTS

| | | | | |
|---|---|---|---|---|
| 354,573 A | | 12/1886 | Norton | |
| 852,360 A | * | 4/1907 | Warner | 215/383 |
| 3,335,902 A | | 8/1967 | Javorik | |
| 3,595,430 A | * | 7/1971 | Massac | 220/560.06 |
| 4,257,257 A | * | 3/1981 | Dairaku et al. | 73/19.02 |
| 4,274,548 A | * | 6/1981 | Schneider | 220/673 |
| 4,804,082 A | * | 2/1989 | Stein | 206/1.5 |
| 4,890,752 A | | 1/1990 | Ota et al. | |
| 5,141,120 A | | 8/1992 | Brown et al. | |
| 5,141,121 A | | 8/1992 | Brown et al. | |
| 5,165,557 A | | 11/1992 | Ota et al. | |
| 5,199,587 A | | 4/1993 | Ota et al. | |
| D344,457 S | | 2/1994 | Prevot et al. | |
| 5,392,937 A | | 2/1995 | Prevot et al. | |
| 5,472,105 A | | 12/1995 | Krishnakumar et al. | |
| 5,598,941 A | | 2/1997 | Semersky et al. | |
| D379,763 S | | 6/1997 | Ewing, Jr. | |
| D382,485 S | | 8/1997 | Kirshnakumar et al. | |
| D385,497 S | | 10/1997 | Kirshnakumar et al. | |
| 5,690,244 A | | 11/1997 | Darr | |
| D393,210 S | | 4/1998 | Ewing, Jr. | |
| 5,758,790 A | | 6/1998 | Ewing, Jr. | |
| 5,988,417 A | | 11/1999 | Cheng et al. | |
| D420,593 S | | 2/2000 | Denner et al. | |
| 6,092,688 A | | 7/2000 | Eberle et al. | |

* cited by examiner

*Primary Examiner*—Lee Young
*Assistant Examiner*—Joseph C. Merek
(74) *Attorney, Agent, or Firm*—Howson and Howson

(57) ABSTRACT

A hot-fillable grip container having a sidewall with a front label panel on which a label can be adhesively secured and prominently displayed. The label panel includes horizontally disposed stiffening grooves and transversely disposed channels connecting between adjacent pairs of grooves. The channels are preferably vertically disposed such that they are perpendicular to said grooves and provide anti-barreling and anti-buckling functions. In addition, the channels enable ready drainage of cooling liquid applied to a hot-filled and capped container so that proper label adhesion can be achieved.

20 Claims, 5 Drawing Sheets

HOT-FILLABLE GRIP CONTAINER HAVING A REINFORCED, DRAINABLE LABEL PANEL

RELATED APPLICATION

This application is a continuation-in-part of co-pending U.S. patent application Ser. No. 09/466,698 filed Dec. 17, 1999 which claims priority to U.S. Provisional Patent Application No. 60/148,872 filed on Aug. 13, 1999.

FIELD OF THE INVENTION

The present invention relates to plastic blow-molded containers having opposed front and rear label panels and opposed grip panels, and more particularly, the present invention relates to hot-fillable grip containers having at least one label panel which is reinforced to resist buckling/barreling and which readily permits the drainage of liquid from an exterior surface thereof to enhance label adhesion.

BACKGROUND OF THE INVENTION

Plastic blow-molded containers, such as beverage containers and wide-mouth jars, have been provided with opposed inset grips to provide relatively large-capacity, consumer-friendly packages that are easy to grip with one hand. For example, juice bottles may be provided in 64 ounce, 96 ounce, or greater capacities, and wide mouth jars containing sauces or like food products may be provided in 20 ounce, 32 ounce, 48 ounce or greater capacities. The use of opposed inset grips enable ready handling of such containers.

Typically, front and rear panels extend between the inset grips and provide areas to which labels are adhered. Thus, a substantially rectangular front label is secured with an adhesive to the front label panel and a separate substantially rectangular rear label is secured with an adhesive to the rear label panel. Typically, the label panels are provided with a plurality of circumferentially-extending, axially-spaced inset ribs to provide hoop strength and rigidify the label panels so that the labels are prominently displayed on the containers.

Examples of blow-molded grip containers which can be hot-filled are provided by U.S. Pat. No. : 5,598,941 issued to Semersky et al.; U.S. Pat. No. 5,392,937 and D.344,457 issued to Prevot et al.; D.420,593 issued to Denner et al.; U.S. Pat. No. 5,472,105 issued to Krishnakumar et al.; and U.S. Pat. Nos. 5,141,121 and 5,141,120 issued to Brown et al. Examples of non-hot-fillable blow-molded grip containers are provided by U.S. Pat. Nos.: 5,758,790, D.393,201 and D.379,763 issued to Ewing, Jr.; D.385,497 and D.382,485 issued to Krishnakumar et al.; and U.S. Pat. Nos. 5,199,587, 5,165,557 and 4,890,752 issued to Ota et al,. All of these containers disclose label panels reinforced with a plurality of circumferentially-extending, axially-spaced inset ribs.

A problem experienced with hot-fill containers is that, after hot-filling, the containers are typically processed through a dunk tank or spray tunnel to accelerate cooling of the containers and their contents so that labels can be secured to the containers with an adhesive. Sometimes cooling liquid, typically water, collects in the circumferentially-extending, axially-spaced inset reinforcement ribs located in the label panels and inhibits proper label application, thereby resulting in an undesirable product display.

In addition, containers are subjected to various forces during high speed hot-filling, cooling, and handling. While the above referenced containers having circumferentially-extending ribs provide desired hoop strength, such ribs do not provide significant resistance to barreling or buckling of the container. For example, during high speed filling or when a significant top load is applied to the container, the label panels may bow outwardly and assume a barrel-like shape in elevation. Alternatively, the label panels, as viewed in an elevation, may buckle inward due to the forces created in the sealed container as its contents cool. In either case, barreling or buckling of the label panel prevents proper label adhesion and prevents the label from being prominently displayed on the container.

U.S. Pat. No. 5,988,417 issued to Cheng et al. and U.S. Pat. No. 6,092,688 issued to Eberle et al. disclose label panels having so-called drainage ports utilized on relatively slender bottles which have relatively small diameters not requiring grips.

The Cheng et al. '417 patent discloses a container having a smooth annular label panel with a series of undulating interconnected grooves extending circumferentially on and below the annular label panel. The undulating grooves provide paths for condensate to drain from underneath a sleeve-shaped label to reduce the potential for condensation-induced delamination. The bottle disclosed in the Cheng et al. '417 patent has a slenderness ratio (ie. height-to-width ratio) of about 3.2:1 and a diameter which can be readily grasped by one hand.

The Eberle et al. '688 patent discloses a container having an annular label panel with six identical and equally spaced-apart flex panels. A spaced apart pair of ramp-shaped projections extend outwardly below each flex panel to provide a drainage path therebetween for permitting liquids to drain from underneath a sleeve-shaped label. The bottle disclosed in the Eberle et al. '688 patent has a slenderness ratio (ie. height-to-width ratio) of about 2.3:1, a capacity of 12 ounces, and a diameter of 60 mm which can readily be grasped by one hand.

A wide mouth jar having an annular label panel and sleeve-shaped label applied thereto is disclosed in U.S. Pat. No. 5,690,244 issued to Darr. The annular label panel has a plurality of spaced apart annular circumferential grooves and a plurality of axially-extending, outwardly-projecting ribs. The vertical ribs and horizontal grooves combine to define a plurality of rectangular flex panels capable of flexing inwardly to accommodate vacuum induced shrinkage of a hot-filled and sealed container. The outwardly projecting ribs also ensure that the label does not directly contact the entire surface of the annular label panel. However, while this structure may enable some liquid to drain from the flex panels into the subjacent annular groove, it does not provide for the escape of liquid which may be trapped in the annular grooves.

While the above referenced grip, and non-grip, blow-molded containers may function satisfactorily for their intended purposes, there is a need for a grip container having a front label panel which is reinforced to resist barreling and buckling and which permits proper drainage of liquid so that labels can be properly adhered to, and prominently displayed on, the label panel. Preferably, the label panels are arcuate, include a series of circumferentially-extending, axially-spaced inset stiffening ribs, and prominently display substantially rectangular-shaped labels secured to the label panels with an adhesive. In addition, preferably the container has a relatively large capacity and a diameter which requires the use of opposed inset grips to enable ready one-hand handling of the container.

OBJECTS OF THE INVENTION

With the foregoing in mind, a primary object of the present invention is to provide a container having an opposed pair of grips and an arcuate front label panel on which a label can be adhesively applied and prominently displayed.

Another object of the present invention is to provide a grip container having a label panel which is reinforced to resist barreling and buckling.

A further object of the present invention is to provide a grip container having a label panel which provides drainage paths for liquid located on its exterior surface to enable better adhesion of a label to the label panel.

A still further object of the present invention is to provide a reinforced, drainable label panel structure for use on a relatively large capacity, hot-fillable grip bottle and grip wide mouth jar.

SUMMARY OF THE INVENTION

More specifically, the present invention provides a hot-fillable container having a pair of opposed inset grips and an arcuate front label panel which includes a series of alternating circumferentially-extending grooves and lands. Each land has at least one transversely-extending inset channel interconnecting to adjacent circumferentially-extending grooves located directly above and below the land. Preferably, the channels and grooves extend inward to an equal depth into the container to enable fluid to readily drain from an exterior surface of the label panel. In addition, preferably the transversely extending channels are axially disposed to provide an anti-barreling and anti-buckling function.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF A PREFERRED EMBODIMENT

Figure 1:
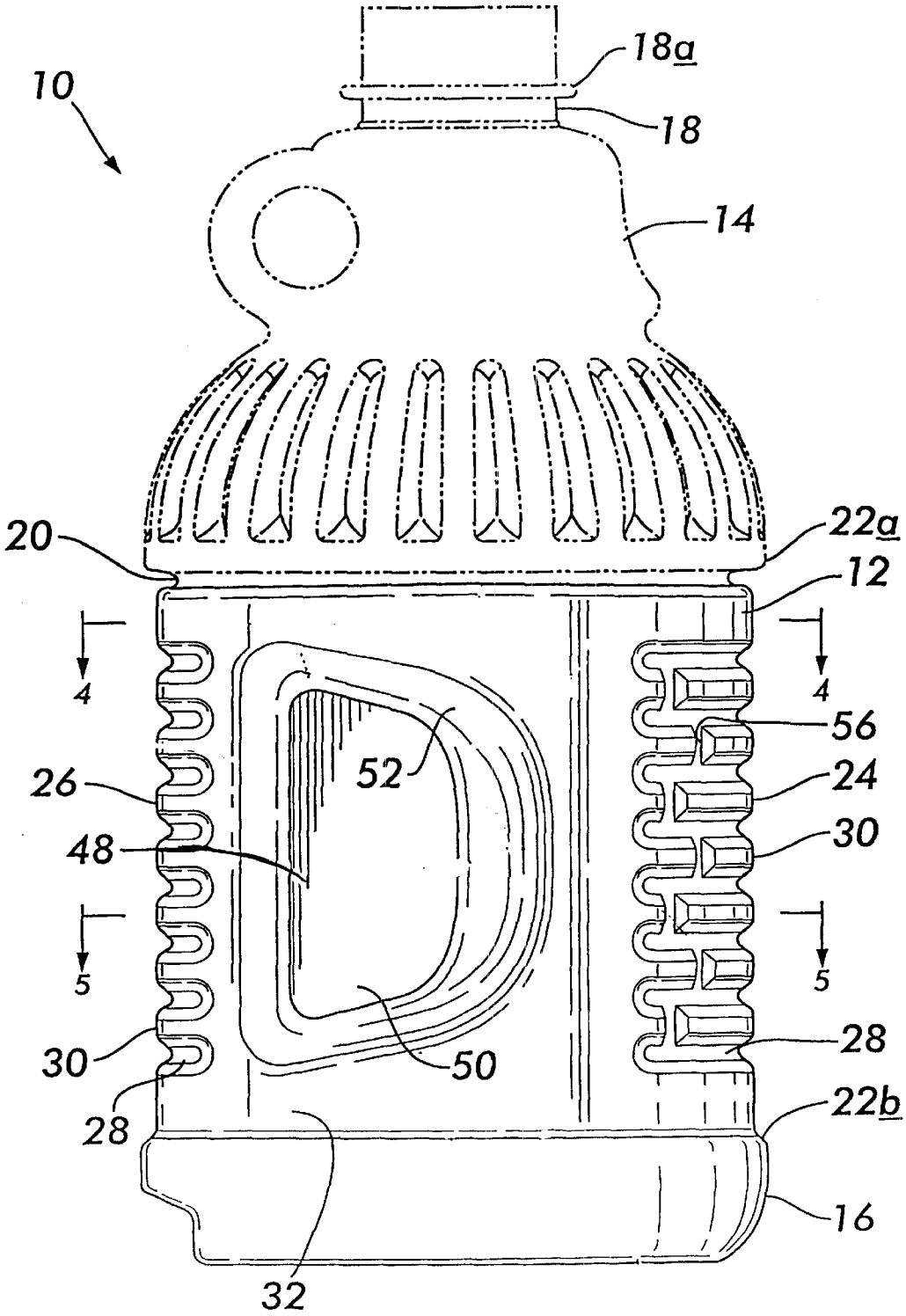
FIG. 1 is a left side elevational view of a container embodying the present invention.

The plastic blow molded container 10 of the present invention illustrated in FIGS. 1–5 is particularly suited for hot-fill packaging of beverages, such as juice. The construction of the sidewall 12 of the container 10 enables the container to accommodate vacuum-induced volumetric shrinkage caused by hot-filling and provides a consumer-friendly package which is easy to grip with one hand so that the container can be lifted and its contents poured readily. Although not illustrated, a hot-fillable, blow-molded wide mouth jar can be provided having a similar gripable sidewall structure.

Structurally, the container 10 has a dome 14 and a base 16 which extend integrally from opposite ends of the sidewall 12. The illustrated dome 14 has an upstanding finish 18 with a peripheral flange 18*a,* is circular in transverse cross-section adjacent the sidewall 12, and interconnects to the sidewall 12 via a peripheral groove 20 that extends inwardly below an upper label bumper 22*a* at the base of the dome 14. Preferably, the base 16 is coaxial with the dome 14, is circular in transverse cross-section adjacent the sidewall 12, and interconnects to the sidewall 12 via a peripheral lower label bumper 22*b.* While a preferred dome and a preferred base are illustrated in the drawings, other dome and base configurations can be utilized with the sidewall 12.

The sidewall 12 has an arcuate front label panel 24 opposite an arcuate rear label panel 26 and interconnected by a pair of identical flex panels, 32 and 34. Preferably, these four panels are all generally rectangular and convex inwardly of the container, and together form the continuous, integral sidewall 12. The different sections of the sidewall 12 provide different functions. For instance, in response to hot-filling, the arcuate label panels, 24 and 26, resist deformation, while the arcuate flex panels, 32 and 34, flex to accommodate volumetric shrinkage of the container 10.

An inset grip region 48 is formed in each flex panel, 32 and 34, to afford facile gripping of the container. Each grip 48 is substantially vertically centered on each flex panel and is horizontally offset rearwardly on each flex panel so as to be located closer to the rear label panel 26 than to the front label panel 24. Preferably, each grip 48 includes an inset, trapezoidal-shaped, planar wall portion 50 surrounded by an integral rigid frame 52.

Figure 2:
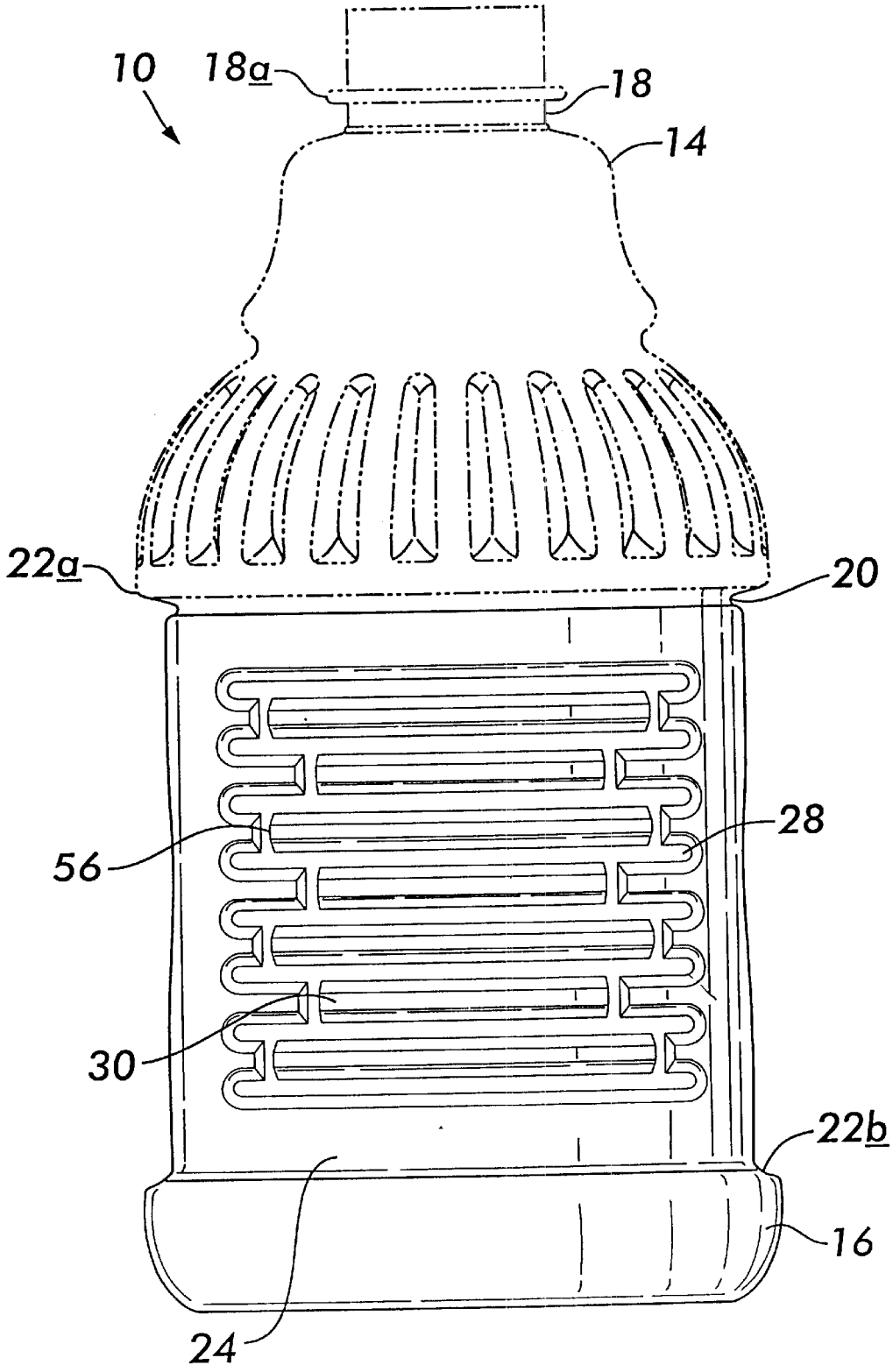
FIG. 2 is a front elevational view of the container illustrated in FIG. 1.
Figure 3:
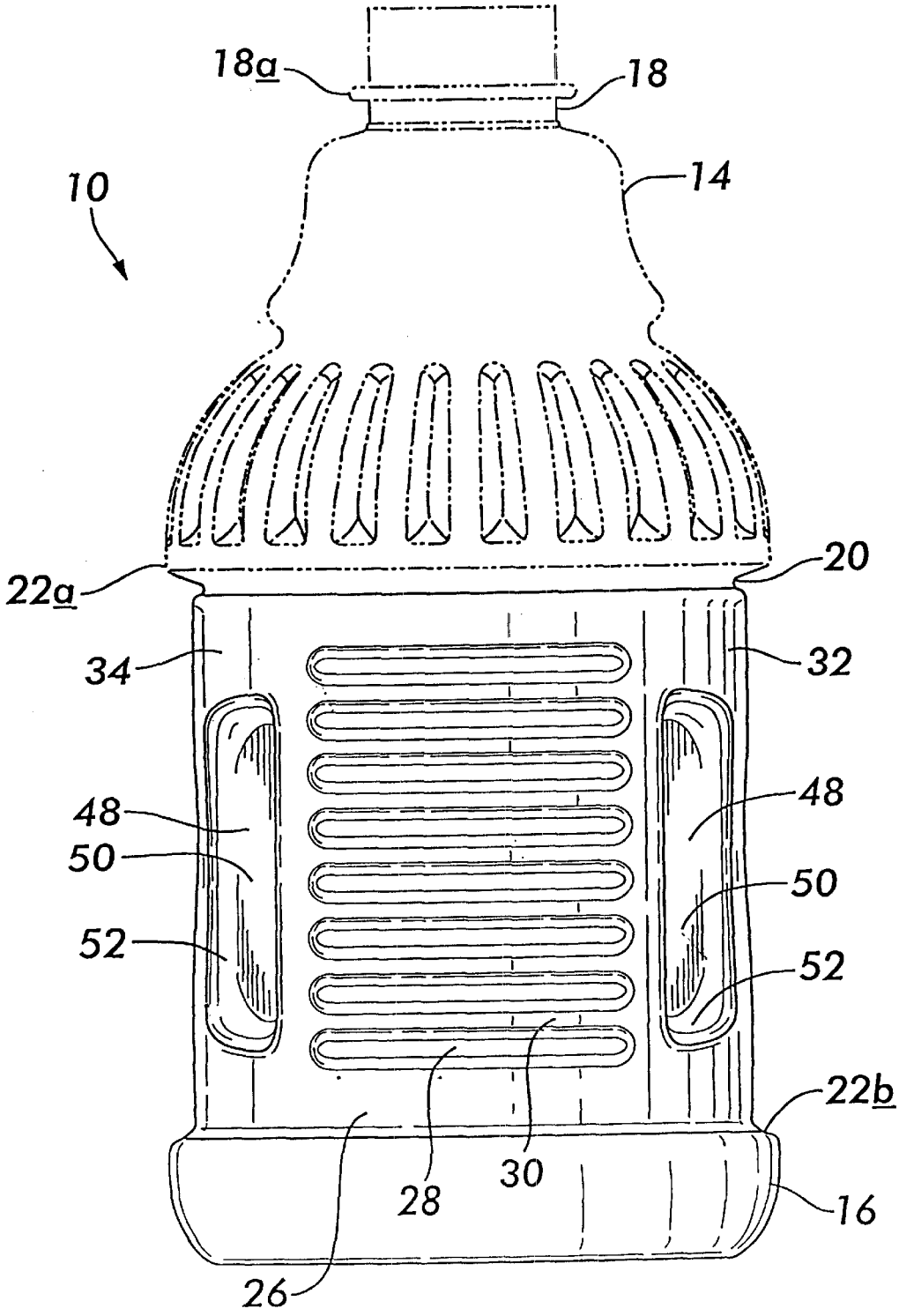
FIG. 3 is a rear elevational view of the container illustrated in FIG. 1.
Figure 4:
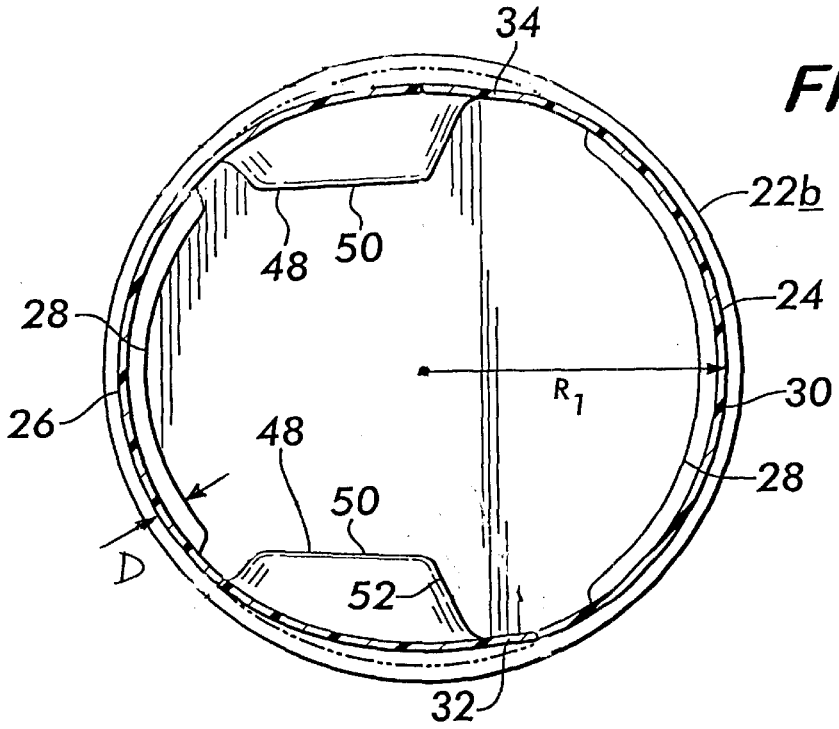
FIG. 4 is a cross-sectional view of the container illustrated in FIG. 1 along the line 4—4.

As best illustrated in FIGS. 2 and 3, the label panels, 24 and 26, extend continuously in a longitudinal direction from the groove 20 below the upper label bumper 22*a* to the lower label bumper 22*b,* and as best illustrated in FIG. 4, each label panel, 24 and 26, has a predetermined radius of curvature $R_1$ throughout its arcuate extent. Preferably, the arcuate extent of the front label panel 24 is greater than the arcuate extent of the rear label panel 26, and the radius of curvature of each is the same.

Figure 5:
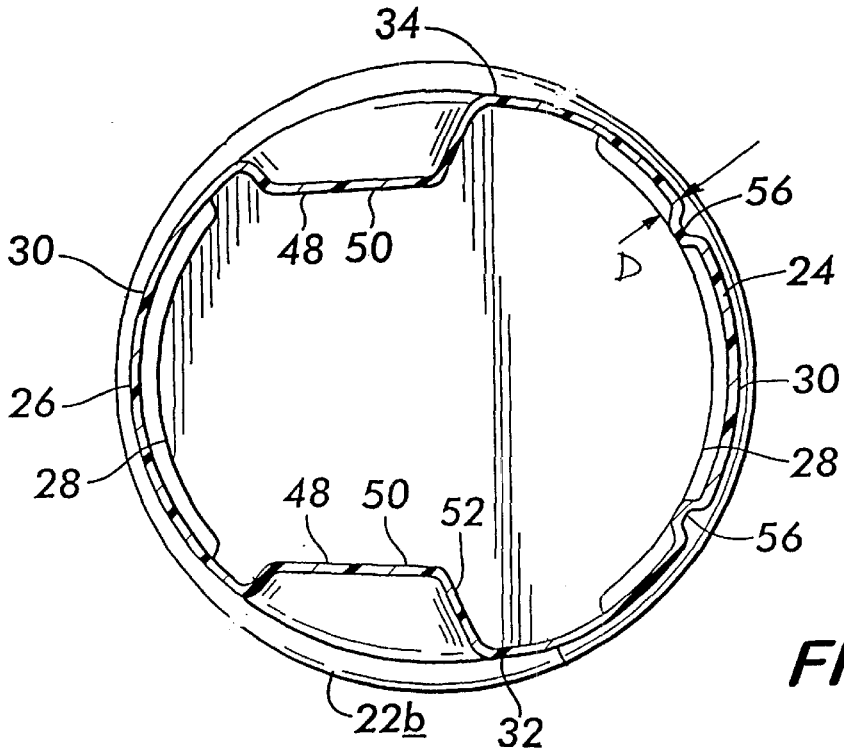
FIG. 5 is a cross-sectional view of the container illustrated in FIG. 1 along the line 5—5.
Figure 6:
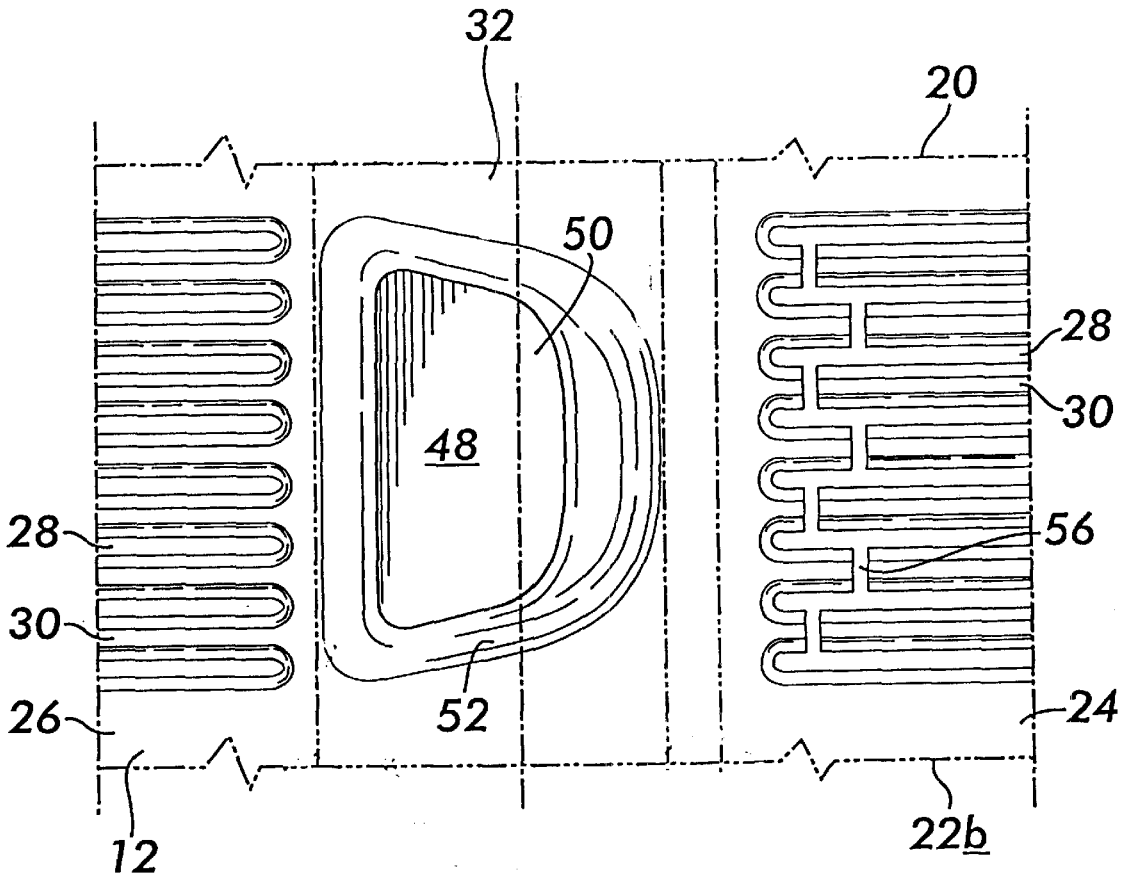
FIG. 6 is a fragmentary, developed view of a 180° section of the sidewall between the middle of the front and rear label panels.

Both label panels, 24 and 26, have a plurality of vertically-spaced circumferential stiffening grooves 28 separated by horizontally elongate lands 30. As best illustrated in FIGS. 4 and 5, the stiffening grooves 28 extend inwardly into the container 10 to a depth "D". The stiffening grooves 28 rigidify the label panels and enable the label panels to resist label panel ovalization deformation. The lands 30 support an adhesively secured label (not shown).

Novel aspects of the present invention reside in the enhanced barreling and buckling resistance of the front label panel 24 and its ability to ensure proper drainage of liquid from its exterior surface before being applied with a label. The above cited functions are provided by forming inset channels 56 in each land 30. Thus, each land 30 has at least one channel 56 which extends transversely across the land 30 and which interconnects the adjacent pair of horizontal stiffening grooves 28. Preferably, as illustrated, the channels 56 are axially disposed on the label panel 24 and extend perpendicular to the grooves 28.

It has been found that this groove and channel arrangement ensures that the front label panel 24 of a hot-filled container, and the label attached thereto, remains in a desired arcuate shape and does not flex, barrel, buckle, or otherwise distort to any undesirable extent. It has also been found that the channels 56 provide an important drainage function. To this end, after the container 10 is hot-filled and capped, cooling of the container 10 and its contents are accelerated by processing the container 10 through a dunk tank or spray tunnel. After the container 10 and its contents are sufficiently cooled, labels are attached to the front and rear label panels, 24 and 26. Preferably, the labels are substantially rectangular and are secured to the container 10 with an adhesive. Water and/or other coolant liquid which would otherwise be trapped in the grooves 28 on the front label panel 24 drains from the grooves 28 through the channels 56. The drainage enables proper and consistent adhesion of the front label to the front label panel 24. If desired, similar channels can also be provided on the rear label panel 26.

Preferably, as illustrated in FIG. 2, the channels 56 are located adjacent the opposite ends of the lands 30, and are arranged in a staggered pattern such that the channels 56 on every other land 30 are vertically aligned. Other channel layout designs can also be used including ones in which the channels are all vertically aligned, or in which none of the channels are vertically aligned. In addition, while the illustrated embodiment utilizes a pair of channels 56 per land 30, more or less channels can be utilized for each or selected lands.

Preferably, the channels 56 and grooves 28 are concave and extend inward to the same depth "D". This ensures that liquid will drain freely from the grooves 28 into the channels 56 and that the interconnection of the grooves 28 and channels 56 do not provide ledges where liquid can become trapped.

Various modifications to the container 10 are contemplated. As illustrated, the drainage channels 56 do not extend below the bottommost groove and the lower edge of the label. However, if desired, additional drainage channels which extend downwardly from the bottommost groove could be utilized. In addition, as stated previously, the disclosed reinforced, drainable label panel structure can be utilized on a blow molded wide mouth jar and can be utilized as the structure for a rear label panel.

By way of example, the illustrated bottle 10 has a capacity to package 64 ounces of juice; has a height of approximately 10 inches from the upper surface of the finish to the seating surface of the base, and has a sidewall diameter of approximately 5 inches. The above dimensions provide the container with a slenderness ratio of about 2:1 (height/width) and a diameter that is difficult to grasp with one hand without the use of inset grips 48. The disclosed label panel 24 is also useful on containers having lesser or greater diameters and slenderness ratios, for example, on containers having at least a 4 inch diameter and a slenderness ratio of less than 2.3:1.

The present invention provides a hot-fillable and grippable blow-molded container which provides a relatively wide front label panel which provides for better labeling to ensure that adhesively secured labels are prominently displayed. At least the front label panel is provided with channels which extend transversely on horizontally disposed lands between horizontally disposed stiffening grooves. The channels enable the label panel to resist buckling and barreling and to provide a drainage path for liquid applied to the exterior of the container for cooling purposes. The described label panel structure is particularly useful for relatively large capacity beverage grip bottles and wide mouth grip jars.

While a preferred embodiment of a label panel for a hot-fillable, gripable container has been described, various modifications, alterations, and changes may be made without departing from the spirit and scope of the present invention as defined in the appended claims.

What is claimed is:

1. A plastic container, comprising:

a blow molded container body having a base, a dome with a finish, and a sidewall located between a peripheral upper label bumper structure and a peripheral lower label bumper structure, said sidewall having a pair of inset grips and at least one label panel extending therebetween, and said sidewall being inset relative to said peripheral upper and lower label bumper structures;

a plurality of vertically-spaced circumferentially-extending stiffening grooves extending inwardly on said label panel;

a label supporting land extending between each adjacent pair of said grooves; and at least one inset channel formed on each of said lands and extending transversely across said land interconnecting an adjacent pair of grooves;

whereby said channels enhance barreling and buckling resistance of said label panel and provide drainage paths to enable improved label adhesion.

2. A container according to claim 1, wherein said inwardly extending grooves and channels extend to an equal depth.

3. A container according to claim 2, wherein said channels are axially disposed on said label panel such that said channels extend perpendicular to said grooves.

4. A container according to claim 3, wherein at least a pair of channels are located on each land, and wherein said pair of channels are located adjacent opposite ends of said land.

5. A container according to claim 4, wherein said channels are arranged in a staggered pattern such that said channels on every other land are vertically aligned.

6. A container according to claim 5, wherein said container body has a circular footprint and a diameter of at least 4 inches.

7. A container according to claim 6, wherein said container body has a slenderness ratio of less than 2.3:1.

8. A container according to claim 7, wherein said blow-molded container body is a hot-fillable beverage bottle.

9. A container according to claim 7, wherein said blow-molded container body is a hot-fillable wide mouth jar.

10. A plastic container, comprising:

a hot-fillable blow molded container body having a base, a dome with a finish, and a sidewall located between a peripheral upper label bumper structure and a peripheral lower label bumper structure, said sidewall having a pair of opposed gripable side panels and opposed arcuate front and rear label panels, said sidewall being inset relative to said peripheral upper and lower label bumper structures, and at least a portion of each side panel being flexible to accommodate volumetric shrinkage of the container;

a plurality of vertically-spaced circumferentially-extending stiffening grooves extending inwardly on said front and rear label panels;

a land extending between each adjacent pair of said grooves; and at least one inset channel formed on each of said lands on said front label panel and extending transversely across said land interconnecting said adjacent pair of grooves of said land for providing drainage paths on an exterior surface of said front label panel.

11. A container according to claim 10, wherein said inwardly extending grooves and channels on said front label panel extend to an identical depth.

12. A container according to claim 11, wherein said channels are axially disposed on said front label panel such that said channels extend perpendicular to said grooves, wherein at least a pair of said channels are located on each land on said front label panel, and wherein said pair of channels are located adjacent opposite ends of said lands so that said channels enhance barreling and buckling resistance of said front label panel.

13. A container according to claim 12, wherein said channels are arranged in a staggered pattern such that said channels on every other land are vertically aligned.

14. A container according to claim 13, wherein said container body has a circular footprint and a diameter of at least 4 inches.

15. A container according to claim 14, wherein said container body has a slenderness ratio of less than 2.3:1.

16. A plastic container, comprising:

a hot-fillable blow molded container body having a base, a dome with a finish, and a sidewall located between a peripheral upper label bumper structure and a peripheral lower label bumper structure, said sidewall having a pair of opposed gripable side panels and opposed arcuate front and rear label panels, said sidewall being inset relative to said peripheral upper and lower label bumper structures, and at least a portion of each side panel being flexible to accommodate volumetric shrinkage of the container;

a plurality of vertically-spaced circumferentially-extending stiffening grooves extending inwardly on said front and rear label panels;

a land extending between each adjacent pair of said grooves; and at least one inset channel formed on each of said lands on said front label panel and extending transversely across said land interconnecting said adjacent pair of grooves of said land for providing drainage paths on an exterior surface of said front label panel;

said inwardly extending grooves and inset channels on said front label panel extending to an identical depth;

said channels being axially disposed on said front label panel such that said channels extend perpendicular to said grooves;

at least a pair of said channels being located on each land on said front label panel; and said pair of channels being located adjacent opposite ends of said lands so that said channels enhance barreling and buckling resistance of said front label panel.

17. A container according to claim 16, wherein said channels are arranged in a staggered pattern such that said channels on every other land are vertically aligned.

18. A container according to claim 16, wherein said container body has a circular footprint and a diameter of at least 4 inches.

19. A container according to claim 16, wherein said container body has a slenderness ratio of less then 2.3:1.

20. A container according to claim 16, wherein said blow-molded container body is selected from a group of a hot-filled beverage bottle and a hot-fillable wide mouth jar.

* * * * *